US011155939B2

(12) United States Patent
D'Agnolo et al.

(10) Patent No.: US 11,155,939 B2
(45) Date of Patent: Oct. 26, 2021

(54) AIR-JET TYPE SPINNING DEVICE

(71) Applicant: SAVIO MACCHINE TESSILI S.p.A., Pordenone (IT)

(72) Inventors: Fabio D'Agnolo, Pordenone (IT); Luca Deotto, Pordenone (IT)

(73) Assignee: SAVIO MACCHINE TESSILI S.P.A.

( * ) Notice: Subject to any disclaimer, the term of this patent is extended or adjusted under 35 U.S.C. 154(b) by 96 days.

(21) Appl. No.: 16/662,259

(22) Filed: Oct. 24, 2019

(65) Prior Publication Data

US 2020/0131673 A1 Apr. 30, 2020

(30) Foreign Application Priority Data

Oct. 24, 2018 (IT) ..... 102018000009728

(51) Int. Cl.
*D01H 4/02* (2006.01)
*D01H 1/115* (2006.01)

(52) U.S. Cl.
CPC ..... *D01H 4/02* (2013.01); *D01H 1/115* (2013.01)

(58) Field of Classification Search
CPC ..... D01H 1/115; D01H 4/02; D01H 4/34
See application file for complete search history.

(56) References Cited

U.S. PATENT DOCUMENTS 5,146,740 A * 9/1992 Mori ..... D01H 1/115 57/328
5,263,310 A * 11/1993 Mori ..... D01H 4/02 57/328
8,607,540 B2 * 12/2013 Betz ..... D01H 7/92 57/350
2014/0208711 A1 * 7/2014 Griesshammer ..... D01H 4/48 57/333
2015/0240394 A1 * 8/2015 Blankenhorn ..... D01H 1/115 57/333
2017/0314166 A1 * 11/2017 D'Agnolo ..... D02G 1/164

FOREIGN PATENT DOCUMENTS

CN 101294319 B 6/2010
EP 2009150 A1 * 12/2008 ..... D01H 4/02
EP 2369043 A2 9/2011
EP 3243941 A1 11/2017
EP 3266910 A1 1/2018

OTHER PUBLICATIONS

Italian Search Report, dated Jul. 8, 2019.

* cited by examiner

*Primary Examiner* — Shaun R Hurley
(74) *Attorney, Agent, or Firm* — Valauskas Corder LLC

(57) ABSTRACT

An air-jet type spinning device comprising at least one injection hole configured to introduce a flow of compressed air in a spinning chamber. A fibre feeding device facing the spinning chamber feeds the fibres in the spinning chamber. A spinning spindle is at least partially inserted in the spinning chamber and fitted with a spinning channel for the transit of yarn obtained from the fibres.

19 Claims, 6 Drawing Sheets

AIR-JET TYPE SPINNING DEVICE

CROSS-REFERENCE TO RELATED APPLICATIONS

The present invention claims priority to Italian Patent Application No. 102018000009728 filed on Oct. 24, 2018.

FIELD OF APPLICATION

The present invention relates to an air-jet type spinning device.

BACKGROUND

As is known, air-jet type spinning devices produce the yarn production starting from a fibre web.

This web is subjected to the action of compressed air jets which allow the outermost fibres to open and wrap around the central ones and form the yarn.

The known solutions have some drawbacks and limitations.

In fact, there are usually 4 or more holes for the injection of compressed air which require a considerable consumption of air with an increase in energy consumption and therefore an increase in the production costs of the yarn.

Moreover, the known solutions, in order to obtain good quality yarns and to limit the consumption of compressed air, require the implementation of spinning chambers of reduced and extremely compact dimensions.

In this way, however, the chambers are extremely sensitive to the possible presence of dirt and fibrils that compromise the quality, repeatability and strength of the yarn.

Moreover, the known solutions entail some structural limits in the implementation of the spinning chamber since the jets of compressed air must be directed in an extremely precise manner in the proximity of the tip of the spinning spindle: in other words, the jets must be directed towards the tangential direction and inclined downwards to obtain the necessary swirling of the compressed air which must, on the one hand, wrap the outer fibres around the inner ones and on the other create the necessary depression to suck the fibres inside the spinning spindle.

Despite these geometric constraints, the known solutions do not always guarantee control of the direction of the compressed air jets inside the spinning chamber since the air, once released from the nozzles, propagates freely inside the spinning chamber and is therefore subject to deviations due both to the presence of impurities, such as fibrils and dirt, and to the presence of turbulence and vorticity.

The prior art solutions do not allow accurately varying the operating conditions of the spinning device and, in particular, the working conditions inside the spinning chamber: such variability of the operating conditions of the spinning, as seen, contributes to a poor repeatability of the quality of the yarn produced.

In conclusion, the known solutions of air-jet devices involve considerable consumption of compressed air, high production costs and do not always guarantee the constancy and repeatability of obtaining a yarn of high quality and strength.

DISCLOSURE OF THE INVENTION

The need of solving the drawbacks and limitations mentioned with reference to the prior art is therefore felt.

Such a need is met by an air-jet type spinning device according to the invention.

DESCRIPTION OF THE DRAWINGS

Further features and advantages of the present invention will appear more clearly from the following description of preferred non-limiting embodiments thereof, in which.

Elements or parts of elements in common to the embodiments described below are referred to with the same reference numerals.

DETAILED DESCRIPTION

Figure 1:
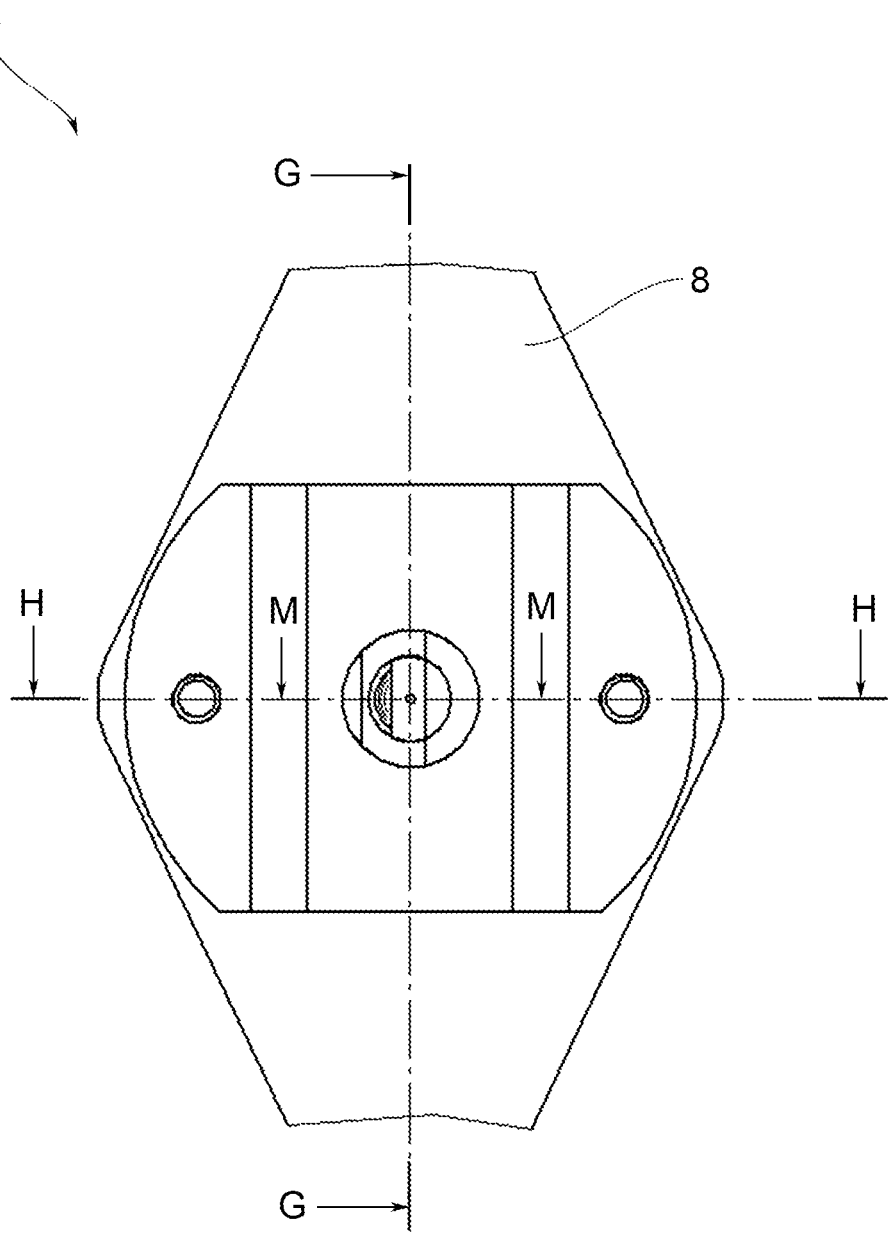
FIG. 1 shows a top view of an air-jet spinning device according to an embodiment of the present invention.
Figure 2:
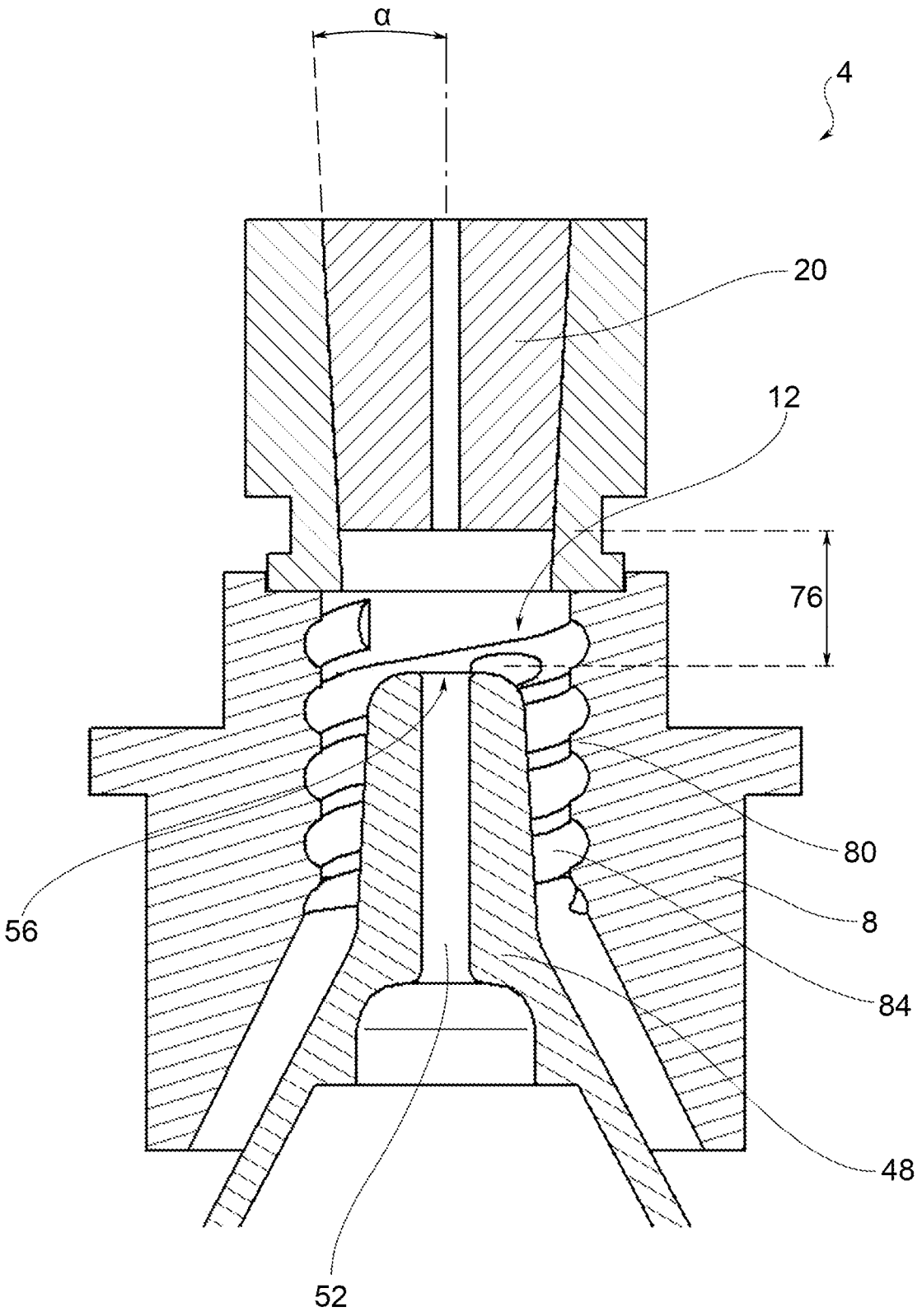
FIG. 2 shows a sectional view of the air-jet spinning device of FIG. 1, along the section plane G-G indicated in FIG. 1.
Figure 3:
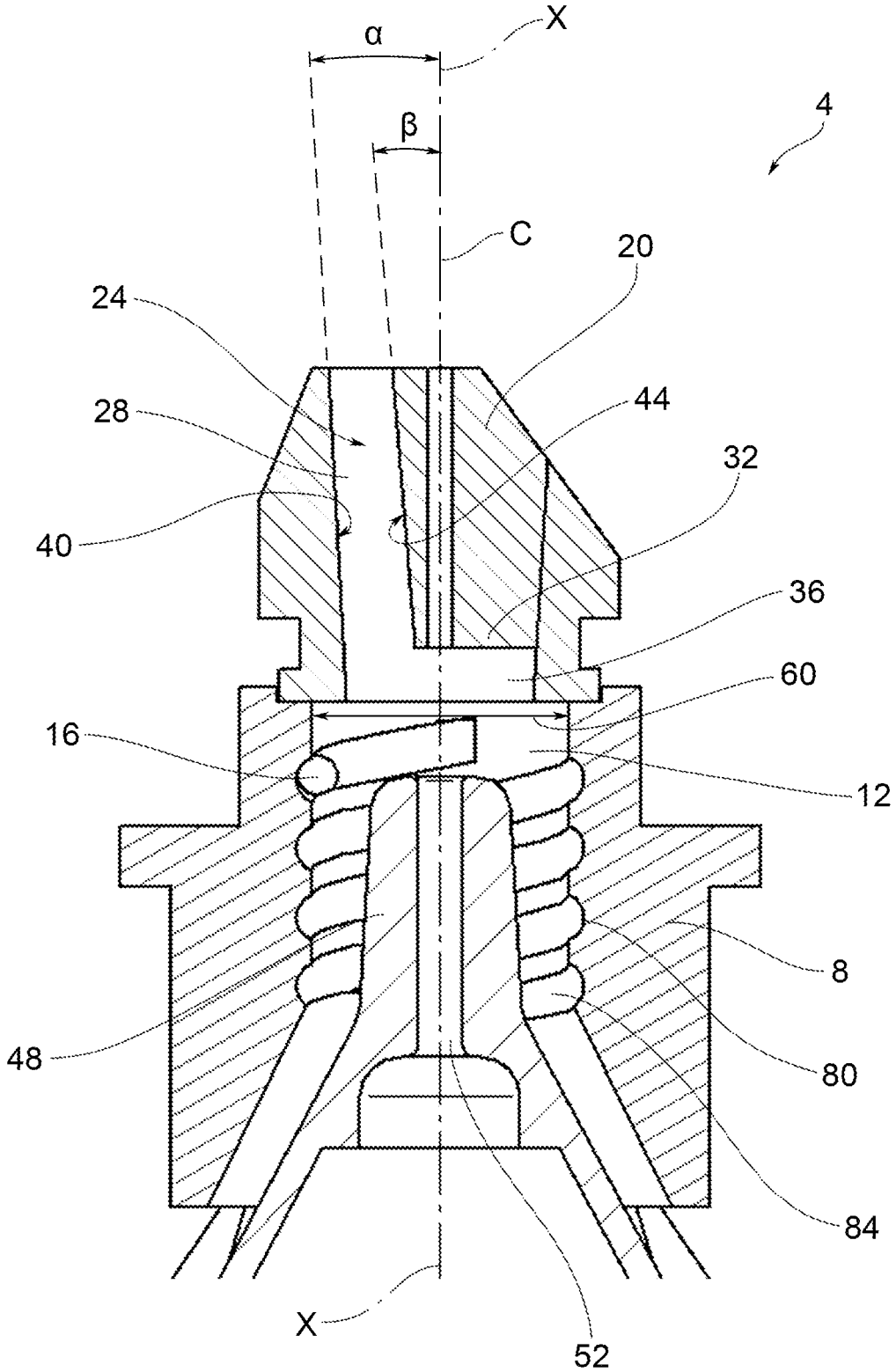
FIGS. 3-4 show two sectional views of the air-jet spinning device of FIG. 1, along the section plane H-H indicated in FIG. 1.
Figure 4:
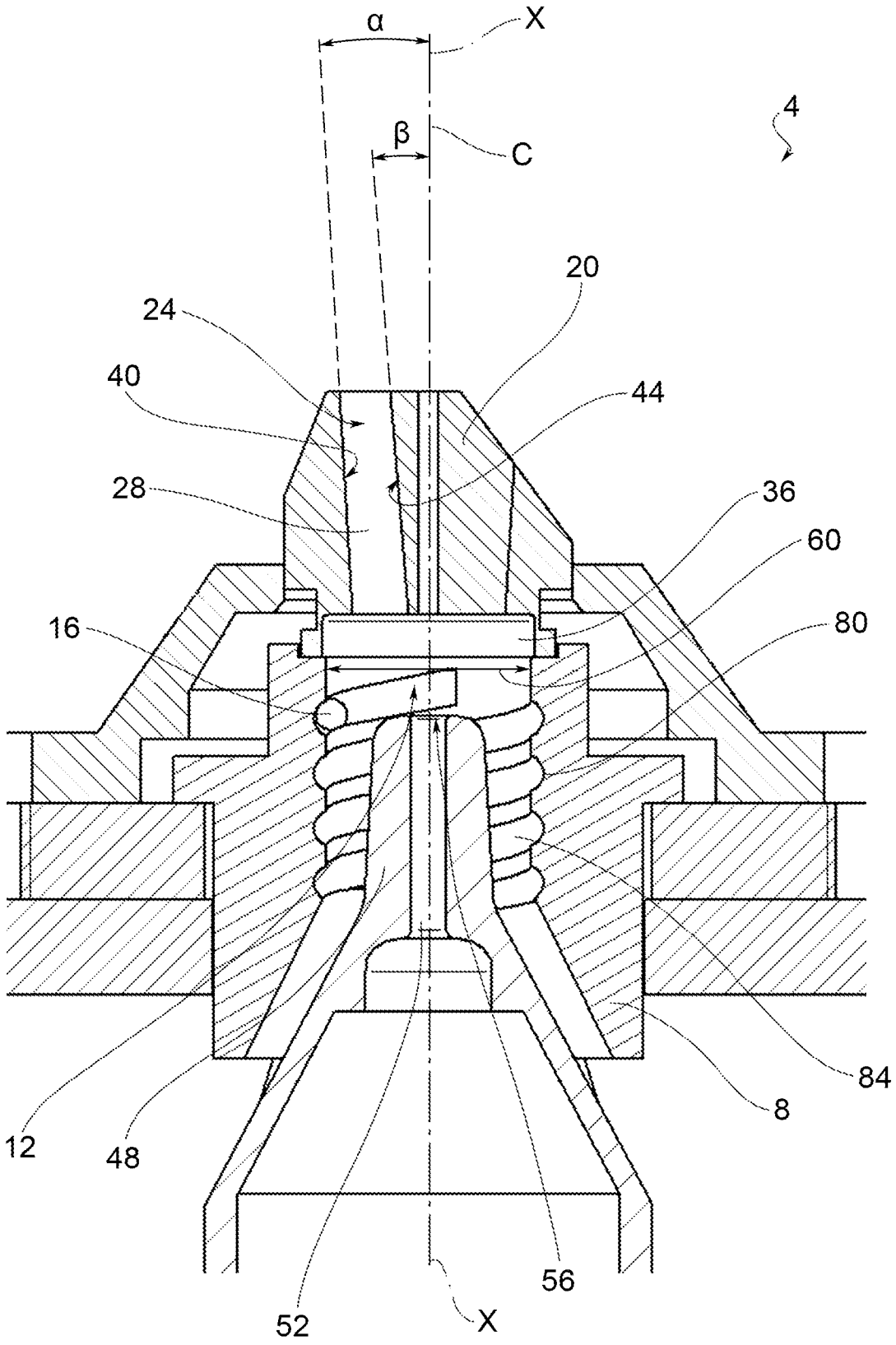
Figure 5:
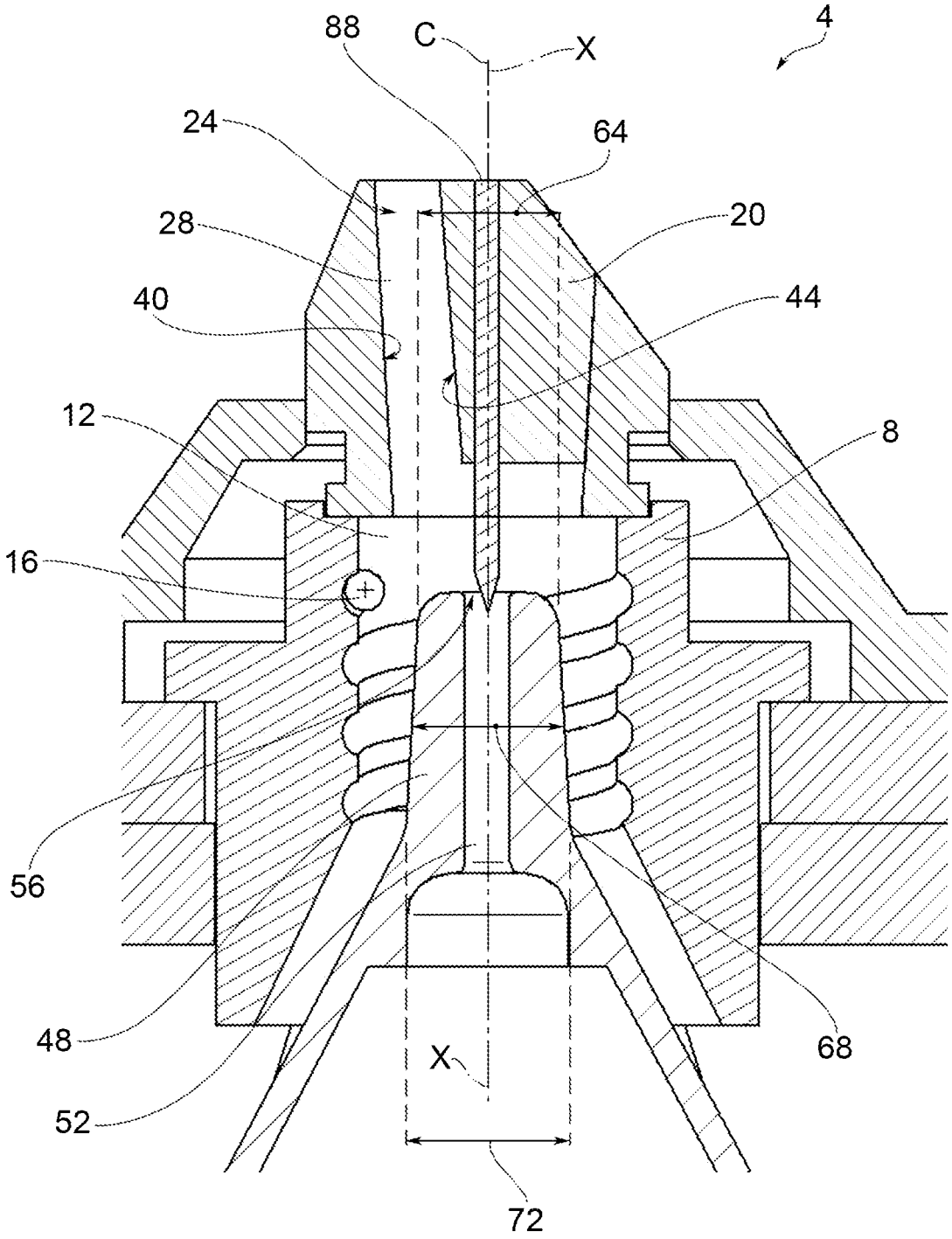
FIGS. 5-6 show two sectional views of the air-jet spinning device of FIG. 1, along the section plane H-H indicated in FIG. 1, according to a possible embodiment variant.
Figure 6:
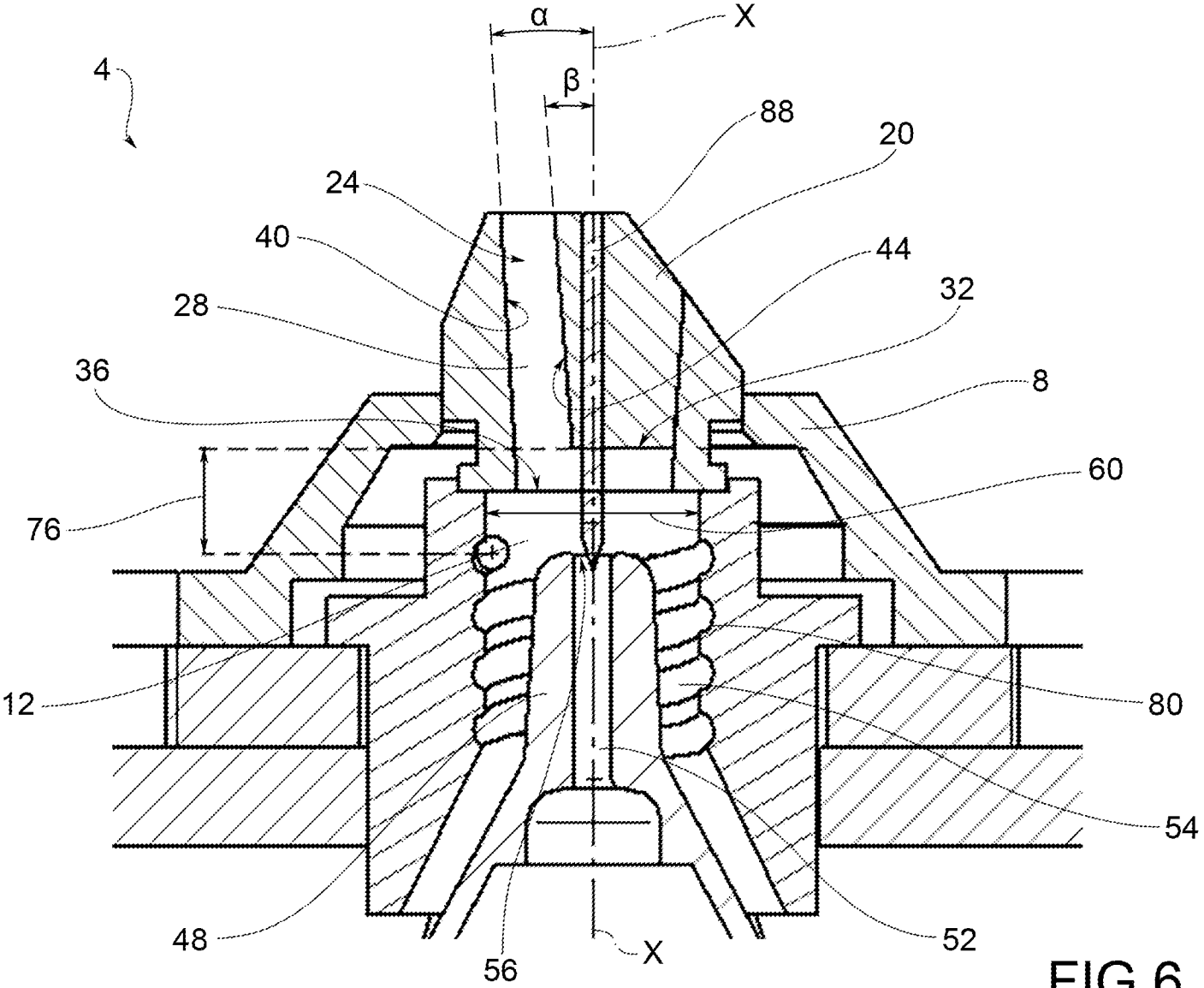

With reference to the aforementioned figures, 4 indicates globally an air-jet type spinning device, comprising an at least partially hollow body 8 which delimits a cylindrical spinning chamber 12.

The body comprises at least one injection hole 16 configured to introduce a flow of compressed air into said spinning chamber 12 and thereby obtain the formation of yarn through the fibre twisting.

For this purpose, the spinning device 4 comprises a fibre feeding device 20, facing said spinning chamber 12 so as to be able to feed the fibres in the spinning chamber 12.

In turn, the fibre feeding device 20 comprises a fibre feeding channel 24 having a first straight section 28 leading, at a shoulder 32, into a pre-chamber 36 facing and communicating with said spinning chamber 12.

Preferably, the first straight section 28 of the fibre feeding channel 24, with respect to a section plane passing through a median plane M-M of the first straight section 28 and through a central axis C-C of the fibre feeding device 20, is inclined (i.e. not parallel) with respect to said central axis C-C.

Preferably, the first straight section 28, with respect to a cross-section plane passing through a median plane M-M of said first straight section 28 and a central axis C-C of the fibre feeding device 20, has a truncated-conical cross-section diverging towards the spinning chamber 12.

According to an embodiment, said first straight section 28, with respect to a cross-section plane passing through a median plane M-M of the first straight section 28 and a central axis C-C of the fibre feeding device 20, is delimited by an external wall 40 inclined with respect to the central axis C-C by an external angle $\alpha$ between 2° and 3.75°.

According to an embodiment, said first straight section 28, with respect to a cross-section plane passing through a median plane M-M of the first straight section 28 and a central axis C-C of the fibre feeding device 20, is delimited by an inner wall 44 inclined with respect to the central axis C-C by an inner angle $\beta$ between 3.5° and 5.5°.

The particular geometrical conformation of the fibre feeding channel 24 contributes to the improved formation of the yarn and to the constancy of the spinning conditions.

The spinning device 4 further comprises a spinning spindle 48 at least partially inserted in the spinning chamber 12 and provided with a spinning channel 52 for the passage of yarn obtained from said fibres.

The spinning channel 52 has a main axis which defines a spinning direction (X-X) and has a front input 56 for introducing the fibres into said spinning channel 52.

Advantageously, the spinning chamber has extremely compact dimensions.

In particular, a diameter 60 of the spinning chamber 12, measured relative to a cross-section plane perpendicular to said main axis, is between 5.6 and 7.4 mm.

According to one embodiment, the spinning spindle 48 has an overall frusto-conical shape with a circular and axially symmetrical section with respect to said spinning direction X-X; in particular, the spinning spindle 48 tapers towards the front input 56.

Preferably, said spinning spindle 48 has an inlet diameter 64, at said front input 56, comprised between 47% and 61% of the diameter 60 of the spinning chamber 12.

Preferably, said inlet diameter 64 is between 3.2 and 3.9 mm.

As mentioned, the spinning spindle 48 has a truncated cone shape, wherein an average diameter 68 of said spinning spindle, at an intermediate height of the spinning spindle 48, is equal to 1.1-1.3 times the inlet diameter 64 of the spinning spindle 48, at said front input 56.

Preferably, a bottom diameter 72 of the spinning spindle 48, on the opposite side to its front input 56, is equal to 1.1-1.3 times said average diameter 68.

The injection hole also has a specific position with respect to the spinning chamber 12 and/or the spinning spindle 48.

In particular, said at least one injection hole 16 is arranged upstream of the front input 56 of the spinning spindle 48, along said spinning direction.

Preferably, said at least one injection hole 16 is arranged at a distance 76 from the shoulder 32 of between 2.4 and 3.5 mm.

Preferably, the distance between the at least one injection hole 16 and the front input 56 of the spinning channel 52, measured parallel to the spinning direction, is greater than or equal to 0.3 mm, and the injection hole 16 is arranged upstream of the front input 56.

In other words, the injection hole 16 is located just upstream, i.e. above, with respect to the front input 56 of the spinning channel 52.

Also the spinning chamber 12 has some peculiarity.

According to an a possible embodiment, the spinning chamber 12 is delimited at least partially by an outer side wall 80, opposite the spinning spindle 48, wherein on said outer side wall 80 at least one thread 84 is made; moreover, said at least one injection hole 16 is oriented so as to direct the jet of compressed air towards the at least one thread 84 so as to be guided and oriented by the latter.

In other words, the thread 84 acts as a guide for the movement of the air flow inside the spinning chamber 12.

Preferably, the at least one thread 84 is a helical thread, coaxial with said spinning channel 52 and parallel to the spinning direction (X-X).

Preferably, the spinning device 4 comprises at least two injection holes 16', 16" which direct compressed air into two distinct emission points of a same helical thread 84; said emission points are diametrically opposed to each other and send jets of compressed air in opposite directions to each other, so as to generate a synchronised motion of vorticity which triggers the twisting of the fibres in the spinning chamber 12.

According to a possible embodiment, said thread 84 has a geometry with a curvilinear or semi-circular section, preferably with a radius of between 0.25 mm and 2 mm.

Preferably, said thread 84 is inclined according to a helix angle of between 5° and 15°.

Preferably, the pitch of said thread 84 is between 1.5 mm and 4 mm.

The outer side wall 80 can also comprise a plurality of threads which direct and guide as many flows of compressed air.

According to an embodiment, the fibre feeding device 20 comprises a needle 88, at least partially penetrated in said spinning chamber 12 and axially opposite said front input 56, so as to create a guide for the fibres being spun.

As can be seen from the above description, the air-jet type spinning device according to the invention allows the drawbacks of the prior art to be overcome.

In particular, the present invention can lead to a reduction in air consumption with respect to the solutions of the prior art, since the total air flow is dosed and optimized in all operating conditions of the device.

In the solution of the present invention, the spinning chamber is wider: this increased space serves to open the fibres and to wind the flow of untwisted central fibres with greater tension and effectiveness. In particular, the increased dimensions of the spinning chamber are important in order to be able to pull the fibres from the outside, making the twisting on the bundle of central fibres more efficient.

These dimensional/geometric expedients allow a net improvement in the quality of the resulting yarn as it is possible to allow more fibres to participate in the formation of the yarn twisting.

Furthermore, as seen, the greater volume available allows managing the possible presence of balls or dust or dirt, as the dimensions allow the escape of said impurities without excessively disturbing the fluid motion field.

It should also be noted that it is possible to use only two air injection holes and reduce the overall working pressure, due to the greater efficiency of the spinning chamber.

This is a further advantage, since interference between the fibres and the air is avoided and therefore the spinning process becomes more controllable, so as to obtain a yarn with features that are as constant and repeatable as possible.

The larger dimensions with respect to the prior art have the advantage of allowing the fibres to "open up" for a longer stretch, without interfering with the outer walls. This allows having longer stretches of wound fibres and therefore greater regularity and strength to the yarn.

Furthermore, in yarns with large counts (thread count<Ne30) the high number of fibres being worked requires additional "space" since the external fibres involved will be higher in number than the average and fine counts and this requires more working space.

A man skilled in the art may make several changes and adjustments to the air-jet type spinning devices described above in order to meet specific and incidental needs, all falling within the scope of protection defined in the following claims.

The invention claimed is:

1. Air-jet type spinning device comprising a body at least partially hollow, which delimits a cylindrical spinning chamber, the body comprising at least one injection hole configured to inject a flow of compressed air into said spinning chamber, a fibre feeding device, facing said spinning chamber so as to feed the fibres into the spinning chamber, the fibre feeding device comprising a fibre feeding channel having a first straight section leading, at a shoulder, into a pre-chamber facing and communicating with said spinning chamber, a spinning spindle at least partially inserted in the spinning chamber and fitted with a spinning channel for the transit of yarn obtained from said fibres, the spinning channel having a main axis which defines a spinning direction, and having a front input for the introduction of the yarn in said spinning channel, wherein a diameter of the spinning chamber, measured relative to a cross-section plane perpendicular to said main axis, is between 5.6 and 7.4 mm, and, wherein the distance between the at least one injection hole and the front input, measured parallel to the spinning direction, is greater than or equal to 0.3 mm, the injection hole being arranged upstream of the front input.

2. Air-jet type spinning device according to claim 1, wherein the spinning spindle has, overall, a truncated cone shape with a circular and axial symmetric cross-section with respect to said spinning direction, the spinning spindle tapering towards the front input.

3. Air-jet type spinning device according to claim 1, wherein said spinning spindle has an inlet diameter, at said front input, between 47% and 61% of the diameter of the spinning chamber.

4. Air-jet type spinning device according to claim 3, wherein said inlet diameter is between 3.2 mm and 3.9 mm.

5. Air-jet type spinning device according to claim 1, wherein the spinning spindle has a truncated cone shape, wherein an average diameter of said spinning spindle, at an intermediate height of the spinning spindle, is equal to 1.1-1.3 times an inlet diameter of the spinning spindle, at said front input.

6. Air-jet type spinning device according to claim 5, wherein a bottom diameter of the spinning spindle, opposite the front input, is equal to 1.1-1.3 times said average diameter.

7. Air-jet type spinning device according to claim 1, wherein the first straight section of the fibre feeding channel, with respect to a cross-section plane passing through a median plane of the first straight section and a central axis of the feeding device, is inclined with respect to said central axis.

8. Air-jet type spinning device according to claim 1, wherein the first straight section, with respect to a cross-section plane passing through a median plane of said first straight section and a central axis of the fibre feeding device, has a truncated-conical cross-section diverging towards the spinning chamber.

9. Air-jet type spinning device according to claim 1, wherein said first straight section, with respect to a cross-section plane passing through a median plane of the first straight section and a central axis of the fibre feeding device, is delimited by an external wall inclined with respect to the central axis by an external angle between 2° and 3.75°.

10. Air-jet type spinning device according to claim 1, wherein said first straight section, with respect to a cross-section plane passing through a median plane of the first straight section and a central axis of the fibre feeding device, is delimited by an inner wall inclined with respect to the central axis by an inner angle between 3.5° and 5.5°.

11. Air-jet type spinning device according to claim 1, in which said at least one injection hole is arranged upstream of the front input of the spinning spindle, along said spinning direction.

12. Air-jet type spinning device according to claim 1, wherein said at least one injection hole is placed at a distance from the shoulder between 2.4 and 3.5 mm.

13. Air-jet type spinning device according to claim 1, wherein the spinning chamber is delimited at least partially by an outer side wall, opposite the spinning spindle, wherein on said outer side wall at least one thread is made, wherein said at least one injection hole is oriented so as to direct the jet of compressed air towards the at least one thread so as to be guided and oriented by the latter.

14. Air-jet type spinning device according to claim 13, wherein said at least one thread is a helical thread.

15. Air-jet type spinning device according to claim 13, wherein the spinning device comprises at least two injection holes that direct compressed air at two separate emission points, said emission points being diametrically opposite each other and sending jets of compressed air in opposite directions to each other.

16. Air-jet type spinning device according to claim 13, wherein said thread has a curved or semi-circular geometry cross-section with a radius between 0.25 mm and 2 mm.

17. Air-jet type spinning device according to claim 13, wherein said thread is inclined at a helix angle of between 5° and 15°.

18. Air-jet type spinning device according to claim 13, wherein the pitch of said thread is between 1.5 mm and 4 mm.

19. Air-jet type spinning device according to claim 1, wherein the fibre feeding device comprises a needle, at least partially penetrated in said spinning chamber and axially counterposed to said front input, so as to create a guide for the fibres being spun.

* * * * *